US011366410B2

(12) United States Patent
Kawashima et al.

(10) Patent No.: US 11,366,410 B2
(45) Date of Patent: Jun. 21, 2022

(54) DEVELOPER CONTAINER, DEVELOPING DEVICE, PROCESS CARTRIDGE, AND IMAGE FORMING APPARATUS

(71) Applicant: Ricoh Company, Ltd., Tokyo (JP)

(72) Inventors: Naohiro Kawashima, Kanagawa (JP); Kei Saito, Tokyo (JP); Kentarou Matsumoto, Tokyo (JP); Kunihiro Ohyama, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/316,797

(22) Filed: May 11, 2021

(65) Prior Publication Data

US 2021/0364950 A1 Nov. 25, 2021

(30) Foreign Application Priority Data

May 25, 2020 (JP) ..... JP2020-090813

(51) Int. Cl.
*G03G 15/08* (2006.01)

(52) U.S. Cl.
CPC ..... *G03G 15/0889* (2013.01); *G03G 15/0867* (2013.01)

(58) Field of Classification Search
CPC ..... G03G 15/0889; G03G 15/0867; G03G 15/0898; G03G 15/0817; G03G 21/1832; G03G 2221/1648
See application file for complete search history.

(56) References Cited

U.S. PATENT DOCUMENTS

| | | | | |
|---|---|---|---|---|
| 5,541,710 | A * | 7/1996 | Stewart | G03G 15/0898 384/147 |
| 2014/0199098 | A1* | 7/2014 | Abe | G03G 15/0817 399/279 |
| 2015/0093144 | A1* | 4/2015 | Sato | G03G 15/0817 399/103 |
| 2016/0195846 | A1 | 7/2016 | Koshizuka et al. | |
| 2017/0108795 | A1 | 4/2017 | Oshikawa et al. | |
| 2017/0115597 | A1 | 4/2017 | Kawashima et al. | |
| 2017/0168418 | A1 | 6/2017 | Takami et al. | |
| 2017/0168421 | A1 | 6/2017 | Koshizuka et al. | |
| 2017/0351195 | A1 | 12/2017 | Koshizuka et al. | |
| 2018/0136586 | A1 | 5/2018 | Tsuchiya et al. | |
| 2019/0286013 | A1 | 9/2019 | Saito et al. | |
| 2020/0026220 | A1 | 1/2020 | Takahashi et al. | |
| 2020/0103824 | A1 | 4/2020 | Oshikawa et al. | |
| 2020/0117119 | A1 | 4/2020 | Mase et al. | |
| 2020/0174400 | A1 | 6/2020 | Kawashima et al. | |

(Continued)

FOREIGN PATENT DOCUMENTS

| | | |
|---|---|---|
| JP | 2005-091773 | 4/2005 |
| JP | 2018-081196 | 5/2018 |

OTHER PUBLICATIONS

U.S. Appl. No. 17/064,604, filed Oct. 7, 2020, Kei Saito, et al.

*Primary Examiner* — Sandra Brase
(74) *Attorney, Agent, or Firm* — Xsensus LLP

(57) ABSTRACT

A developer container to store developer includes a rotator, a bearing, and a seal. The rotator includes a rotary shaft made of metal. The bearing supports the rotary shaft. The seal is made of fiber, disposed toward an inside of the developer container in the bearing, and contacts an outer circumferential surface of the rotary shaft.

16 Claims, 3 Drawing Sheets

(56) References Cited

U.S. PATENT DOCUMENTS

| | | | | |
|---|---|---|---|---|
| 2020/0257220 | A1* | 8/2020 | Saito | G03G 21/1832 |
| 2021/0041806 | A1 | 2/2021 | Tsuchiya et al. | |
| 2021/0080856 | A1 | 3/2021 | Hashikawa et al. | |

* cited by examiner

DEVELOPER CONTAINER, DEVELOPING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-090813, filed on May 25, 2020, in the Japan Patent Office, the entire disclosure of which is hereby incorporated by reference herein.

BACKGROUND

Technical Field

Embodiments of the present disclosure generally relate to a developer container to store developer such as toner or two component developer therein, a developing device and a process cartridge that include the developer container, and an image forming apparatus.

Related Art

An image forming apparatus such as a copier, a printer, or the like includes a developer container (a developer stirrer). The developer container includes a seal such as a G seal that is a rubber seal or a V-ring that is a rubber ring. The seal is on a bearing that supports a rotary shaft of a rotator such as a conveying screw to prevent developer stored in the developer container from leaking.

SUMMARY

This specification describes an improved developer container to store developer. The developer container includes a rotator, a bearing, and a seal. The rotator includes a rotary shaft made of metal. The bearing supports the rotary shaft. The seal is made of fiber, disposed toward an inside of the developer container in the bearing, and contacts an outer circumferential surface of the rotary shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
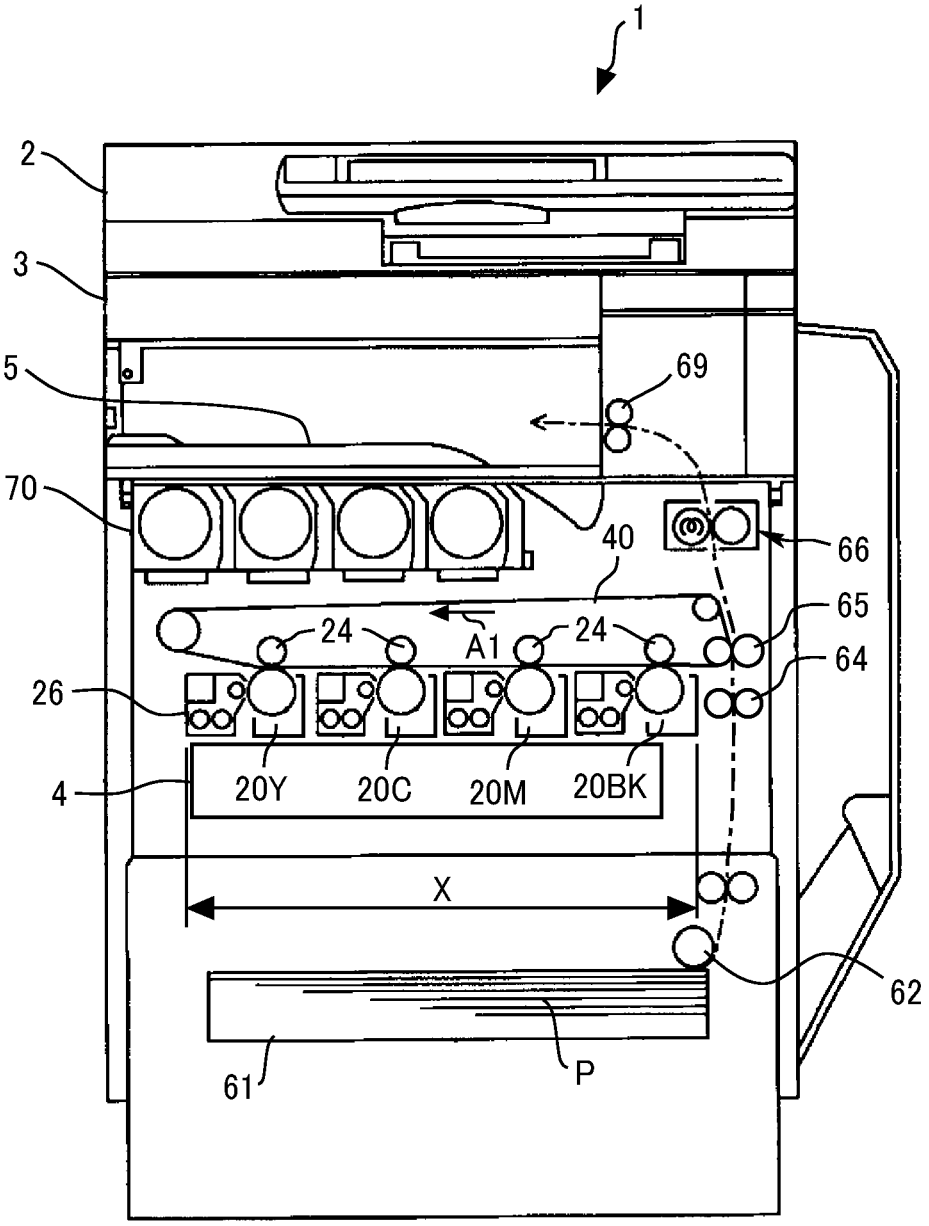
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to the drawings, embodiments of the present disclosure are described below. Identical reference numerals are assigned to identical components or equivalents and a description of those components is simplified or omitted.

Initially with reference to FIG. 1, a description is given of overall configuration and operation of an image forming apparatus 1 according to an embodiment of the present disclosure.

Figure 2:
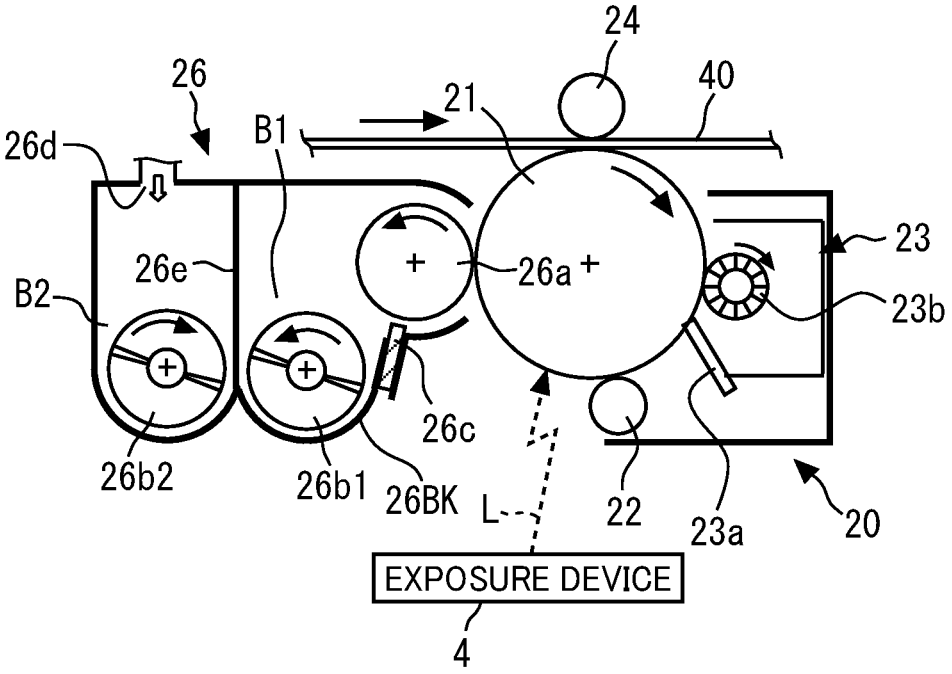
FIG. 2 is a schematic cross-sectional view of an image forming unit (a process cartridge) of the image forming apparatus in FIG. 1.

The image forming apparatus 1 according to the present embodiment is a tandem multicolor image forming apparatus in which process cartridges 20Y, 20M, 20C, and 20BK are arranged in parallel to each other, facing an intermediate transfer belt 40. In each of the process cartridges 20Y, 20M, 20C, and 20BK, a developing device 26 as a developer container is installed to face a photoconductor drum 21 as illustrated in FIG. 2.

In FIG. 1, the image forming apparatus 1, which is a color copier in the present embodiment, includes a document conveyance device 2, a scanner 3 as a document reading device, and an exposure device 4 as a writing device. The document conveyance device 2 conveys a document to the scanner 3. The scanner 3 reads image data of the document. The exposure device 4 emits a laser beam based on input image data.

In addition, the image forming apparatus 1 includes the process cartridges 20Y, 20M, 20C, and 20BK to form yellow, magenta, cyan and black toner images on respective surfaces of the photoconductor drums, respectively, and an intermediate transfer belt 40 on which the yellow, magenta, cyan and black toner images are transferred and superimposed.

The image forming apparatus 1 further includes a sheet feeder 61 to accommodate sheets P such as paper sheets, a secondary transfer roller 65 to transfer the toner image formed on the intermediate transfer belt 40 onto the sheet P, a fixing device 66 to fix the unfixed toner image on the sheet P, and toner containers 70 to supply toners of respective colors to the developing devices 26 of the corresponding process cartridges 20Y, 20M, 20C, and 20BK.

Each of the process cartridges 20Y, 20M, 20C, and 20BK includes the photoconductor drum 21 as an image bearer, a charging device 22, and a cleaning device 23, which are united as a single unit as illustrated in FIG. 2. Each of the process cartridges 20Y, 20M, 20C, and 20K, which is expendable, is replaced with a new one when depleted in a main body of the image forming apparatus 1.

In each of the process cartridges 20Y, 20M, 20C, and 20BK, the developing device 26 is installed to face the photoconductor drum 21. The developing device 26 is expendable and replaced with a new one when depleted in the main body of the image forming apparatus 1. An operator can independently perform an installation and removal operation of the developing device 26 with respect to the main body of the image forming apparatus 1 and an installation and removal operation of the process cartridges 20Y, 20M, 20C, and 20BK with respect to the main body of the image forming apparatus 1 as different operations.

In the process cartridges 20Y, 20M, 20C, and 20BK, yellow, magenta, cyan, and black toner images are formed on the respective photoconductor drums 21 as the image bearers.

The following is a description of image forming processes in the image forming apparatus 1 to form a color toner image on a sheet P.

A conveyance roller of the document conveyance device 2 conveys a document on a document table onto a platen (exposure glass) of the scanner 3. The scanner 3 optically scans image data for the document on the platen.

The yellow, magenta, cyan, and black image data are transmitted to the exposure device 4. The exposure device 4 irradiates the photoconductor drums 21 (see FIG. 2) of the corresponding process cartridges 20Y, 20M, 20C, and 20BK with laser beams (as exposure light) L based on the yellow, magenta, cyan, and black image data, respectively.

Each of the four photoconductor drums 21 rotates clockwise in FIGS. 1 and 2. The surface of the photoconductor drum 21 is uniformly charged at a position where the photoconductor drum 21 faces the charging device 22 that is a charging roller, which is referred to as a charging process. As a result, a charging potential is formed on the surface of the photoconductor drum 21. When the charged surface of the photoconductor drum 21 reaches a position to receive the laser beam L emitted from the exposure device 4, an electrostatic latent image based on the image data is formed on the surface of the photoconductor drum 21, which is referred to as an exposure process.

The laser beam L corresponding to the yellow image data is directed to the surface of photoconductor drum 21 in the process cartridge 20Y, which is the first from the left in FIG. 1 among the four process cartridges 20Y, 20M, 20C, and 20BK. A polygon mirror that rotates at high velocity deflects the laser beam L for yellow along the rotation axis direction of the photoconductor drum 21 (i.e., the main-scanning direction) so that the laser beam L scans the surface of the photoconductor drum 21. Thus, an electrostatic latent image for yellow is formed on the surface of the photoconductor drum 21 charged by the charging device 22.

Similarly, the laser beam L corresponding to the cyan image data is directed to the surface of the photoconductor drum 21 in the second process cartridge 20C from the left in FIG. 1, thus forming an electrostatic latent image for cyan on the surface of the photoconductor drum 21. The laser beam L corresponding to the magenta image data is directed to the surface of the photoconductor drum 21 in the third process cartridge 20M from the left in FIG. 1, thus forming an electrostatic latent image for magenta on the photoconductor drum 21. The laser beam L corresponding to the black image data is directed to the surface of the photoconductor drum 21 in the fourth process cartridge 20BK from the left in FIG. 1, thus forming an electrostatic latent image for black on the photoconductor drum 21.

Then, the surface of the photoconductor drum 21 having the electrostatic latent image reaches a position opposite the developing device 26. The developing device 26 deposits toner of each color onto the surface of the photoconductor drum 21 and develops the electrostatic latent image on the photoconductor drum 21 into a toner image, which is referred to as a development process.

After the development process, the surfaces of the photoconductor drums 21 reach positions facing the intermediate transfer belt 40. The primary transfer rollers 24 are disposed at the positions where the photoconductor drums 21 face the intermediate transfer belt 40 and in contact with an inner circumferential surface of the intermediate transfer belt 40, respectively. At the positions of the primary transfer rollers 24, the toner images on the photoconductor drums 21 are sequentially transferred to and superimposed on the intermediate transfer belt 40, forming a multicolor toner image thereon, which is referred to as a primary transfer process.

After the primary transfer process, the surface of the photoconductor drum 21 reaches a position opposite the cleaning device 23. The cleaning device 23 collects untransferred toner remaining on the photoconductor drum 21, which is referred to as a cleaning process.

Subsequently, a residual potential of the surface of the photoconductor drum 21 is removed at a position opposite the discharger, and a series of image forming processes performed on the photoconductor drum 21 is completed.

Meanwhile, the surface of the intermediate transfer belt 40, onto which the single-color toner images on the photoconductor drums 21 are superimposed, moves in the direction indicated by arrow A1 in FIG. 1 and reaches a position opposite the secondary transfer roller 65. The secondary transfer roller 65 secondarily transfers the multicolor toner image on the intermediate transfer belt 40 to the sheet P, which is referred to as a secondary transfer process.

After the secondary transfer process, the surface of the intermediate transfer belt 40 reaches a position opposite a belt cleaning device. The belt cleaning device collects untransferred toner on the intermediate transfer belt 40 to complete a series of transfer processes on the intermediate transfer belt 40.

The sheet P is conveyed from the sheet feeder 61 to the position of the secondary transfer roller 65 via a registration roller pair 64.

Specifically, a sheet feed roller 62 feeds the sheet P from top of multiple sheets P accommodated in the sheet feeder 61, and the sheet P is conveyed to a registration roller pair 64 through a sheet feed path. The sheet P that has reached the registration roller pair 64 is conveyed toward the position of the secondary transfer roller 65, timed to coincide with the arrival of the multicolor toner image on the intermediate transfer belt 40.

Subsequently, the sheet P, onto which the multicolor image is transferred, is conveyed to the fixing device 66. The fixing device 66 includes a fixing roller and a pressure roller pressing against each other. In a nip between the fixing roller and the pressure roller, the multicolor image is fixed on the sheet P.

After the fixing process, an output roller pair 69 ejects the sheet P as an output image to the exterior of the image forming apparatus 1, and the ejected sheet P is stacked on an output tray 5 to complete a series of image forming processes.

Next, with reference to FIGS. 2 and 3, the image forming units of the image forming apparatus 1 are described in detail below.

The four image forming units in the main body of the image forming apparatus 1 have a similar configuration except the color of the toner used in the image forming processes. Therefore, parts of the image forming unit such as the process cartridge and the developing device are illustrated without suffixes Y, M, C, and BK, which denote the color of the toner, in the drawings.

As illustrated in FIG. 2, the process cartridge 20 mainly includes the photoconductor drum 21 as the image bearer, the charging device 22, and the cleaning device 23, which are stored in a case of the process cartridge 20 as a single unit.

The photoconductor drum 21 is an organic photoconductor designed to be charged with a negative polarity and includes a photosensitive layer formed on a drum-shaped conductive support.

The charging device 22 is the charging roller including a conductive core and an elastic layer of moderate resistivity coated on the conductive core. A power supply applies a predetermined voltage to the charging device 22 that is the charging roller, and the charging device 22 uniformly charges the surface of the photoconductor drum 21 opposite the charging device 22.

The cleaning device 23 includes a cleaning blade 23*a* and a cleaning roller 23*b* that contact the photoconductor drum 21. For example, the cleaning blade 23*a* is made of rubber, such as urethane rubber, and contacts the surface of the photoconductor drum 21 at a predetermined angle with a predetermined pressure. The cleaning roller 23*b* is a brush roller in which brush bristles are provided around a core.

Figure 3:
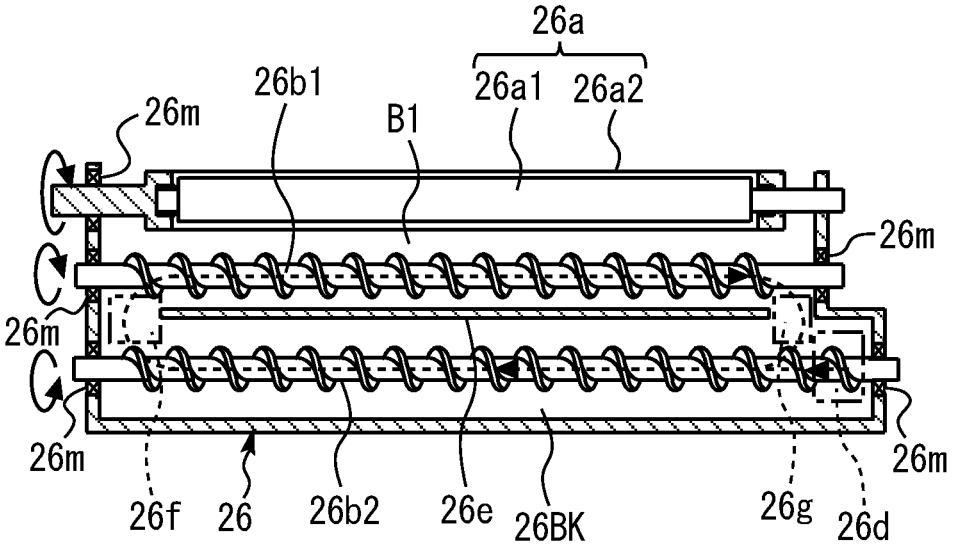
FIG. 3 is a schematic cross-sectional view of a developing device of the image forming unit in FIG. 2 as viewed along a longitudinal direction of the developing device.

As illustrated in FIGS. 2 and 3, the developing device 26 as the developer container mainly includes a developing roller 26*a* as a developer bearer, a first conveying screw 26*b*1 as a first conveyor and a rotator facing the developing roller 26*a*, a partition 26*e*, a second conveying screw 26*b*2 as a second conveyor and a rotator facing the first conveying screw 26*b*1 via the partition 26*e*, and a doctor blade 26*c* as a developer regulator facing the developing roller 26*a* to regulate an amount of developer borne on the developing roller 26*a*.

The developing device 26 stores a two-component developer including carrier and toner.

The developing roller 26*a* is opposed to the photoconductor drum 21 with a small gap, thereby forming a developing range. As illustrated in FIG. 3, the developing roller 26*a* includes stationary magnets 26*a*1 inside and a sleeve 26*a*2 that rotates around the magnets 26*a*1. The magnets 26*a*1 generate multiple poles (magnetic poles) around the outer circumferential surface of the developing roller 26*a*.

The first conveying screw 26*b*1 and the second conveying screw 26*b*2 as rotators convey the developer stored in the developing device 26 in the longitudinal direction of the developing device 26, thereby establishing a circulation path indicated by the dashed arrow in FIG. 3. That is, the first conveying screw 26*b*1 establishes a first conveyance path B1, and the second conveying screw 26*b*2 establishes a second conveyance path B2. The circulation path of the developer is composed of the first conveyance path B1 and the second conveyance path B2.

The partition 26*e* is an inner wall and separates the first conveyance path B1 from the second conveyance path B2, and the first and second conveyance paths B1 and B2 communicate with each other via first and second communication openings 26*f* and 26*g* disposed at both ends of the first and second conveyance paths B1 and B2 in the longitudinal direction. Specifically, with reference to FIG. 3, in a conveyance direction of the developer, an upstream end of the first conveyance path B1 communicates with a downstream end of the second conveyance path B2 via the first communication opening 26*f*. Additionally, in the conveyance direction of the developer, a downstream end of the first conveyance path B1 communicates with an upstream end of the second conveyance path B2 via the second communication opening 26*g*. That is, the partition 26*e* is disposed along the circulation path in the longitudinal direction except both end of the circulation path.

The first conveying screw 26*b*1 in the first conveyance path B1 is opposite the developing roller 26*a*, and the second conveying screw 26*b*2 in the second conveyance path B2 is opposite the first conveying screw 26*b*1 in the first conveyance path B1 via the partition 26*e*. The first conveying screw 26*b*1 supplies developer to the developing roller 26*a* and collects the developer that separates from the developing roller 26*a* after the development process while conveying the developer in the longitudinal direction of the developing device 26. The second conveying screw 26*b*2 stirs and mixes the developer after the development process conveyed from the first conveyance path B1 with a fresh toner supplied from a replenishing port 26*d* while conveying the developer in the longitudinal direction of the developing device 26.

In the present embodiment, the first and second conveying screws 26*b*1 and 26*b*2 are horizontally arranged in parallel. Each of the first and second conveying screws 26*b*1 and 26*b*2 includes a rotary shaft 261 and a screw blade 262 wound around the rotary shaft 261 (see FIG. 4).

A further detailed description is given of the image forming processes described above, focusing on the development process.

The developing roller 26*a* rotates counterclockwise in FIG. 2. As illustrated in FIGS. 2 and 3, the first conveying screw 26*b*1 and the second conveying screw 26*b*2 are disposed facing each other with the partition 26*e* interposed therebetween and rotate in directions indicated by arrows in FIGS. 2 and 3. Toner is supplied from the toner container 70 to the replenishing port 26*d* via a toner supply path. As the first conveying screw 26*b*1 and the second conveying screw 26*b*2 rotate in the respective directions in FIG. 2, the developer stored in the developing device 26 circulates in the longitudinal direction of the developing device 26, that is, the direction indicated by the dashed arrow in FIG. 3, and the supplied toner is stirred and mixed with the developer circulating.

Stirring the developer causes the toner to be charged by friction with carrier in the developer and electrostatically attracted to the carrier. A magnetic force is generated on the developing roller 26*a* to scoop up the carrier. The magnetic force that is called as a developer scooping pole scoop up the carrier with the toner on the developing roller 26*a*. The developer borne on the developing roller 26*a* is conveyed in the counterclockwise direction indicated by arrow in FIG. 2 to a position opposite the doctor blade 26*c*. The doctor blade 26*c* adjusts an amount of the developer on the developing roller 26*a* at the position. Subsequently, rotation of the sleeve 26*a*2 conveys the developer to a developing range in which the developing roller 26 faces the photoconductor drum 21. The electric field formed in the developing range deposits toner on the electrostatic latent image formed on the photoconductor drum 21. As the sleeve 26*a*2 rotates, the developer remaining on the developing roller 26*a* reaches above the first conveyance path B1 and separates from the developing roller 26*a*. In the developing range, a predetermined voltage as a developing bias is applied to the developing roller 26*a* by a development power supply, and a surface potential as a latent image potential is formed on the photoconductor drum 21 in the charging process and the exposure process. The developing bias and the latent image potential form an electric field in the developing range.

The toner in the toner container 70 is supplied through the replenishing port 26*d* to the developing device 26 as the toner in the developing device 26 is consumed. The toner consumption in the developing device 26 is detected by a toner concentration sensor that magnetically detects a toner concentration in the developer (i.e., a ratio of toner to the developer) in the developing device 26.

The replenishing port 26*d* is disposed above an end of the second conveying screw 26*b*2 in the second conveyance path B2 in the longitudinal direction that is the left and right direction in FIG. 3.

The configuration and operation of the developing device 26 as the developer container according to the present embodiment are described in further detail below.

As described above with reference to FIGS. 2 and 3, the developing device 26 as the developer container contains the two-component developer as the developer therein.

Figure 4:
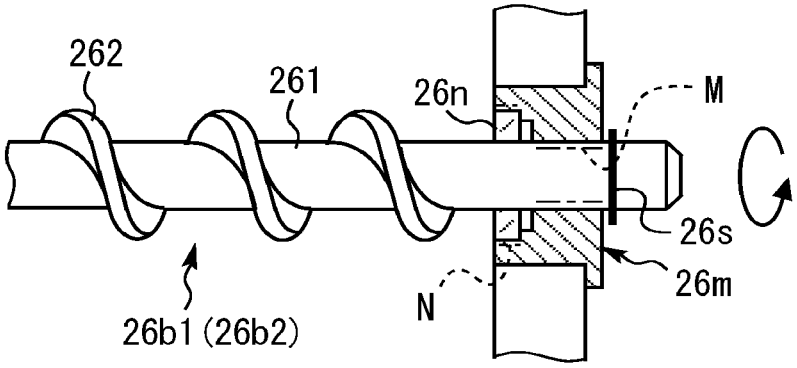
FIG. 4 is a schematic cross-sectional view illustrating the vicinity of a bearing in the developing device in FIG. 3.

The developing device 26 as the developer container includes the first conveying screw 26*b*1 and the second conveying screw 26*b*2 as rotators. As illustrated in FIG. 4, each of the first conveying screw 26*b*1 and the second conveying screw 26*b*2 as rotators includes the rotary shaft 261 made of metal and the screw blade 262 spirally wound around the rotary shaft 261.

In the present embodiment, a main part of the rotary shaft 261 is made of free-cutting steel that is referred to as SUM in the Japanese Industrial Standard (JIS), and the outer circumferential surface of the main part of the rotary shaft 261 is plated with nickel. That is, the rotary shaft 261 includes a surface layer made of nickel plating on a shaft member made of free-cutting steel. In other words, the rotary shaft 261 is made of free-cutting steel and has nickel plating as an example of plating.

The rotary shaft 261 configured as described above is softer than a rotary shaft made of stainless steel, that is, steel use stainless (SUS), but the component cost of the rotary shaft 261 is lower than the rotary shaft made of stainless steel. In particular, making the entire part of the rotary shaft 261 by free-cutting steel, that is, not making a part of the rotary shaft by free-cutting steel improves the component cost reduction effect.

The rotary shaft 261 plated with nickel and made of free-cutting steel has larger hardness and higher antirust effect than the rotary shaft made of free-cutting steel but not plated with nickel. Nickel plating has higher antirust effect than other plating.

In addition, the rotary shaft 261 made of metal easily releases heat in the developer stored in the developing device 26 to the outside of the developing device 26. Accordingly, the rotary shaft 261 made of metal can reduce the deterioration of the developer due to the heat.

In the present embodiment, instead of forming the screw blade 262 made of metal to cover the shaft portion of the rotary shaft 261 made of a metal, the screw blade 262 may be made of resin and formed by insert molding. In such a case, the screw blade 262 does not need to cover the entire of the shaft portion. The screw blade 262 may cover a part (for example, about ⅔) of the shaft portion. In the developing device 26 described above, an exposed metal part of the shaft portion of the rotary shaft 261 contacts (in other words, is buried in) the developer stored in the developing device 26.

The shaft portion of the rotary shaft 261 described above easily releases the heat of the developer to the outside of the developing device 26 even if the screw blade 262 is made of resin and by insert molding and can reduce the deterioration of the developer due to the heat.

On the other hand, the screw blade 262 made of resin and formed by insert molding so as to cover the entire shaft portion of the rotary shaft 261 does not release heat from a heat source such as a motor at one end of the rotary shaft 261 to the inside of the developing device 26 and transmits the heat to the other end of the rotary shaft 261 to release the heat to the outside of the developing device 26. The above-described configuration can reduce the deterioration of the developer in the developing device 26 caused by the heat from the heat source. The heat source is not limited to a motor and may be a gear driven by a driver as long as it generates heat.

The developing device 26 as the developer container includes bearings 26*m* to support the rotary shafts 261 of the first conveying screw 26*b*1 and the second conveying screw 26*b*2.

Specifically, the bearing 26*m* is a slide bearing made of a low friction resin material. As illustrated in FIG. 3, the bearings 26*m* support both ends of each of the rotary shafts 261 of the first conveying screw 26*b*1 and the second conveying screw 26*b*2.

Referring to FIG. 4, the bearing 26*m* has a shape like a doughnut and includes a flange portion that is in contact with an outer wall of a developing case that is a housing of the developing device 26. The bearing 26*m* is inserted into a hole formed in the developing case.

The rotary shaft 261 is inserted into the bearing 26*m* and projects outside (right side in FIG. 4) from the bearing 26*m*. The projected portion of the rotary shaft 261 has a groove. A retaining ring 26*s* is attached to the groove to position the rotary shaft 261 in a rotation axis direction. Thus, the first conveying screw 26*b*1 and the second conveying screw 26*b*2 in the developing device 26 are positioned in the rotation axis direction.

The bearing 26*m* includes a bearing main portion M which the rotary shaft 261 contacts and slides on and a holding portion N having an inner radius larger than that of the bearing main portion M. The holding portion N is disposed toward inside (left side in FIG. 4) of the developing device 26 from the bearing main portion M. A seal 26*n* described below is held in the holding portion N.

In the present embodiment, the bearing 26*m* is the slide bearing but not limited to this. For example, the bearing 26*m* may be a ball bearing. When the bearing 26*m* is the ball bearing, the ball bearing is press-fitted into the bearing main portion M of the bearing 26*m*.

As illustrated in FIG. 4, the seal 26*n* is disposed toward the inside of the developing device 26 as the developer container in the bearing 26*m*. In other words, the seal 26*n* is disposed toward the inside of the developing device 26 from the bearing main portion M in the bearing 26*m* and positioned to be in contact with the developer in the developing device 26. The seal 26*n* prevents the developer in the developing device 26 from entering the bearing main portion M.

The seal 26*n* in the present embodiment is made of fiber, has a shape like a doughnut, and is in contact with the outer circumferential surface of the rotary shaft 261. Specifically, the seal 26*n* is formed in a brush shape from pile fabric and is installed integrally with the bearing 26*m*.

More specifically, the pile fabric is made of fibers of resin such as polyester, nylon, rayon, acrylic, vinylon, or vinyl chloride and, for example, has a brush having a fur length of about 0.2 to 20 mm and brush densities of about 2 to 100,000 F/inch$^2$. The brush may be a loop shape or straight shape that is made by cutting a tip of the loop shape brush. The seal 26*n* is made from the pile fabric to be the shape like the doughnut and have the tip of the brush toward the inside of the doughnut shape.

The seal 26*n* made of fiber described above contacts the rotary shaft 261 with less force than a seal made of rubber but has a good sealing performance. As a result, the rotary shafts 261 of the first and second conveying screws 26*b*1 and 26*b*2 and the seal 26*n* are less likely to wear over time, and the sealing performance of the seal 26*n* is less likely to deteriorate.

In particular, the rotary shaft 261 in the present embodiment is made of free-cutting steel, applied nickel plating, which is soft and easily worn. The configuration of the present disclosure is useful. In addition, the seal 26*n* made of fiber can prevent the nickel plating applied to the rotary shaft 261 from peeling off and reduce a disadvantage caused by deterioration of the antirust effect of the nickel plating.

Next, a variation of the present embodiment is described.

Figure 5:
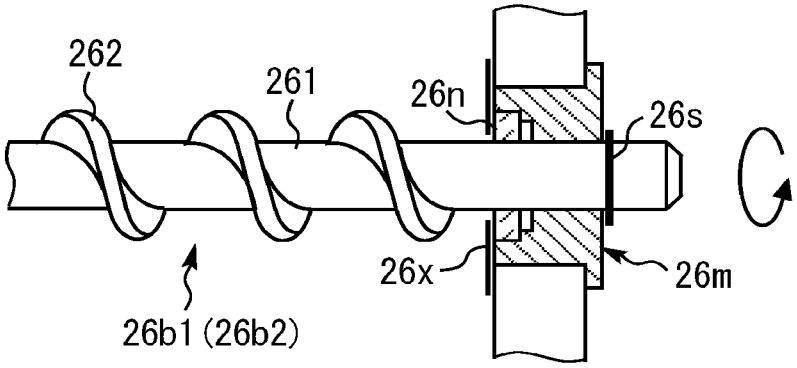
FIG. 5 is a schematic cross-sectional view illustrating the vicinity of a bearing in a developing device according to a variation.

As illustrated in FIG. 5, the developing device 26 as the developer container in the variation includes a flexible sheet 26*x* disposed toward the inside of the developing device 26 with respect to the seal 26*n* made of fiber, that is, left side from the seal 26*n* made of fiber in FIG. 5. The flexible sheet 26*x* is in contact with an end of the seal 26*n* made of fiber.

The flexible sheet 26*x* has a shape like a doughnut and made of polyethylene terephthalate (PET) film with a thickness of 0.01 mm to 0.15 mm. The radius of an inner hole portion of the flexible sheet 26*x* into which the rotary shaft 261 is inserted is similar to or slightly larger than the radius of the rotary shaft 261. That is, the difference between the radius of the inner hole of the flexible sheet 26*x* and the radius of the rotary shaft 261 is set to be less than 1.0 mm, preferably, 0.05 mm to 0.5 mm. In addition, the outer radius of the flexible sheet 26*x* is larger than the inner radius of the hole in the developing case into which the bearing 26*m* is inserted. The flexible sheet 26*x* is adhered to the inner surface of the developing case so as to support the seal 26*n* from the inside.

Setting the flexible sheet 26*x* configured as described above can reduce a disadvantage that the developer in the developing device 26 enters the seal 26*n* and prevent a disadvantage that the seal 26*n* falls off from the bearing 26*m*. Accordingly, the variation can prevent the sealing performance of the seal 26*n* from deteriorating over time.

As described above, the developing device 26 according to the present embodiment includes the developer container to store the developer, the conveying screws 26*b*1 and 26*b*2 as rotators including the rotary shafts 261 made of metal, and the bearing 26*m* supporting the rotary shaft 261. In addition, the developing device 26 according to the present embodiment includes the seal 26*n* made of fiber, disposed toward the inside of the developing device 26 from the bearing 26*m*, and contacting the outer circumferential surface of the rotary shaft 261.

The above-described configuration can prevent the sealing performance of the seal 26*n* from deteriorating over time.

In the present embodiment, the process cartridge 20 does not include the developing device 26, and the developing device 26 is a unit that can be independently installed in and removed from the main body of the image forming apparatus 1. In contrast, the developing device 26 may be one of the constituent members of the process cartridge 20, and the process cartridge 20 may be configured to be integrally installed in and removed from the main body of the image forming apparatus 1.

In such a configuration, similar effects to those of the above-described embodiment and variations are also attained.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together, and is designed to be removably installed as a united part in the main body of the image forming apparatus.

In the present embodiment according to the present disclosure, the developing device 26 includes two conveying screws 26*b*1 and 26*b*2 as the conveyors horizontally arranged in parallel and the doctor blade 26*c* disposed below the developing roller 26*a*. The configuration of the developing device to which the present disclosure is applied is not limited to the above-described configurations. The present disclosure may be applied to other developing devices such as a developing device in which three or more conveyors are arranged in parallel in the horizontal direction, a developing device in which multiple conveyors are arranged in parallel in the vertical direction, and a developing device in which the doctor blade is disposed above the developing roller.

In the present embodiment according to the present disclosure, the developing device 26 includes the two-component developer including toner and carrier. Alternatively, the developing device to which the present disclosure is applied may include a one-component developer (i.e., toner, which may include additives).

Such cases also provide substantially the same effects as the effects described above.

In the present embodiment, the seal 26*n* made of fiber is disposed on the bearing 26*m* supporting the first and second conveying screws 26*b*1 and 26*b*2 as the rotators but may be disposed on the bearing 26*m* supporting another member such as the developing roller 26*a*.

The present embodiment of the present disclosure is applied to the developing device 26 as the developer container but is not limited to this. The present embodiment may be applied to the developer container storing the developer inside, such as a toner container, a toner supply device, a cleaner, a toner conveyance device, and a waste-toner container.

Such cases also provide substantially the same effects as the effects described above.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

The embodiments of the present disclosure have been described in detail above. The above-described embodiments are examples and can be modified within the scope not departing from the gist of the present disclosure. For example, any embodiment and any modification may be combined.

Numerous additional modifications and variations are possible in light of the above teachings. It is therefore to be understood that within the scope of the appended claims, the present disclosure may be practiced otherwise than as specifically described herein. The number, position, and shape of the components of the image forming apparatus described above are not limited to those described above.

What is claimed is:

1. A developer container configured to store developer, comprising:

a rotator including a rotary shaft made of metal;

a bearing supporting the rotary shaft;

a seal made of fiber, disposed toward an inside of the developer container in the bearing, and contacting an outer circumferential surface of the rotary shaft; and a flexible sheet disposed toward an inside of the developer container with respect to the seal and contacting an end of the seal.

2. The developer container according to claim 1, wherein the rotary shaft is made of steel.

3. The developer container according to claim 2, wherein the rotary shaft is made of free-cutting steel.

4. The developer container according to claim 1, wherein the rotary shaft is plated.

5. The developer container according to claim 4, wherein the rotary shaft is plated with nickel.

6. The developer container according to claim 1, wherein the bearing includes:

a bearing main portion on which the rotary shaft slides; and a holding portion holding the seal and having an inner radius larger than an inner radius of the bearing main portion.

7. The developer container according to claim 1, wherein the seal is made of pile fabric and has a brush shape, and the seal is integrated with the bearing.

8. A developing device configured to develop a latent image formed on a surface of an image bearer, the developing device comprising the developer container according to claim 1.

9. A process cartridge configured to be removably installed to a main body of an image forming apparatus, comprising:

the developing device according to claim 8; and the image bearer.

10. An image forming apparatus comprising the developer container according to claim 1.

11. A developer container configured to store developer, comprising:

a rotator including a rotary shaft made of metal;

a bearing supporting the rotary shaft;

a seal made of fiber, disposed toward an inside of the developer container in the bearing, and contacting an outer circumferential surface of the rotary shaft; and a flexible sheet disposed toward an inside of the developer container with respect to the seal and contacting an end of the seal, the flexible sheet having a hole with a radius slightly larger than a radius of the rotary shaft supported by the bearing.

12. The developer container according to claim 11, further comprising a case wherein the case includes a hole into which the bearing is inserted, and an outer radius of the flexible sheet is larger than a radius of the hole of the case.

13. The developer container according to claim 12, wherein the flexible sheet is adhered to the case.

14. An image forming apparatus comprising the developer container according to claim 13.

15. A developing device configured to develop a latent image formed on a surface of an image bearer, the developing device comprising the developer container according to claim 11.

16. A process cartridge configured to be removably installed to a main body of an image forming apparatus, comprising:

the developing device according to claim 15; and an image bearer.

* * * * *